United States Patent [19]

Lathrop et al.

[11] 4,126,450

[45] Nov. 21, 1978

[54] CONTINUOUSLY CASTABLE ZINC BASE ALLOY

[75] Inventors: Michael A. Lathrop, Muncie; Robert D. Mantyla, Yorktown, both of Ind.

[73] Assignee: Ball Corporation, Muncie, Ind.

[21] Appl. No.: 782,333

[22] Filed: Mar. 29, 1977

[51] Int. Cl.[2] ..... C22C 18/04

[52] U.S. Cl. ..... 75/178 AM; 75/178 AT; 148/32

[58] Field of Search ..... 75/178 AM, 178 AT; 148/32

[56] References Cited

U.S. PATENT DOCUMENTS

| | | | |
|---|---|---|---|
| 2,102,869 | 12/1937 | Winter | 75/178 AM |
| 3,850,622 | 11/1974 | Balliett | 75/178 AM |

*Primary Examiner*—R. Dean

*Attorney, Agent, or Firm*—Gilbert E. Alberding

[57] ABSTRACT

An improved continuously castable zinc base alloy comprises 4–10 percent by weight aluminum, 1–6 percent by weight copper and 0.02–0.04 percent by weight magnesium, the balance being zinc. One preferred composition consists essentially of 9.5 percent by weight aluminum, 5.5 percent by weight copper and 0.03 percent by weight magnesium, the balance being zinc. Another preferred continuously castable zinc base alloy consists essentially of 6.5 percent by weight aluminum, 3.8 percent by weight copper and 0.03 percent by weight magnesium, the balance being zinc. The zinc alloys of this invention exhibit highly favorable levels of tensile strength as well as tensile strength stability characteristics.

5 Claims, No Drawings

CONTINUOUSLY CASTABLE ZINC BASE ALLOY

BACKGROUND OF THE INVENTION

This invention relates to improved wrought zinc alloys and more particularly to eutectic and near eutectic zinc alloys which are eutectic and near eutectic compositions consisting essentially of zinc, aluminum, copper and magnesium, having highly favorable castability, tensile strength, tensile strength stability, shear strength, and platability characteristics. The zinc alloys of the present invention are ideally suited to continuous casting operations and in this regard are superior to eutectoid and near eutectoid compositions comprising zinc, aluminum, copper and magnesium. This is due in large measure to the small freezing range of the eutectic and near eutectic alloys of this invention.

Eutectoid and near eutectoid alloys, i.e., those containing about 20–25% aluminum have been found to present continuously casting difficulties attributable to segregation and shrinkage. Further, it has been found that casting high aluminum content alloys involves high energy requirements because of their relatively high pouring temperatures. Moreover the eutectoid and near eutectoid alloy systems generally precluded the implementation of relatively simple, efficient and economic procedures conventionally employed with eutectic and near eutectic alloy systems.

SUMMARY OF THE INVENTION

It has now been discovered that the disadvantages of known eutectoid and near eutectoid zinc alloys can be overcome by the present invention which is directed to low-aluminum content zinc alloys which are near eutectic compositions consisting essentially of zinc, aluminum, copper and magnesium. In particular, the alloy compositions of the subject invention relate to improved continuously castable zinc base alloys comprising about 4–10 weight percent aluminum, about 1–6 weight percent copper and about 0.02–0.04 weight percent magnesium, the balance being zinc.

The alloy composition of this invention may also possibly include, as impurities, the following elements in the amounts indicated: Cd — 0.005 wt % max; Fe — 0.100 wt % max; Pb — 0.007 wt % max; and Sn — 0.005 wt % max. Thus, in the alloy composition of this invention the impurities content does not exceed 0.117 weight percent thereof.

In one embodiment of the present invention, the zinc base alloy consists essentially of 9–10 percent by weight aluminum, 5–6 percent by weight copper, 0.02–0.04 percent by weight magnesium, the balance being zinc. The above indicated impurities may possibly also be present. A more preferred alloy composition of this embodiment consists essentially of 9.4–9.6 percent by weight aluminum, 5.4–5.6 percent by weight copper, 0.028–0.032 percent by weight magnesium, the balance being zinc. Again the above indicated impurities, not exceeding 0.117 weight percent of the alloy composition, may possibly be present. An optimal alloy composition of this embodiment consists essentially of 9.5 percent by weight aluminum, 5.5 percent by weight copper, 0.03 percent by weight magnesium, the balance being zinc, with the possible presence of said impurities not exceeding the amounts indicated above.

In another preferred embodiment of the present invention, the zinc base alloy consists essentially of 6.4–6.6 percent by weight aluminum, 3.7–3.9 percent by weight copper, 0.02–0.04 percent by weight magnesium, the balance being zinc. The above indicated impurities may also be present. An optimal alloy composition of this embodiment consists essentially of 6.5 percent by weight aluminum, 3.8 percent by weight cooper, 0.03 percent by weight magnesium, the balance being zinc, with the possible presence of the said impurities not exceeding the amounts indicated above.

It is therefore a principal object of the present invention to provide novel zinc-based alloys which exhibit improved tensile strength, tensile strength stability, shear strength, continuous casting properties and plating deposition characteristics which are at least comparable to, if not improved over, those of known zinc alloys.

It is another object of this invention to produce a zinc base alloy composition having improved wrought characteristics.

As is generally known, the eutectic alloys including zinc base alloys are known to possess suitable casting properties. On the other hand, these particular alloy systems do not often yield suitable tensile properties, especially in the order of about 50,000 psi and still have suitable stability over a given extended period of time. As a general rule, zinc base alloys are not particularly noted for these high tensile properties. In essence, it was surprising, therefore, to find that the alloys of the subject invention not only exhibited high tensile strength and tensile strength stability, but they also exhibited the advantageous casting characteristics of standard die-cast grade zinc alloys.

EXAMPLE 1

A zinc alloy having the following composition was prepared: 9.5% Al, 5.50% Cu and 0.03% Mg, the balance being zinc from 2.375 lbs of aluminum, 1.375 lbs of copper, 0.381 lbs of magnesium and 20 lbs 13.9 ounces of zinc.

The said alloy, having a heat of transformation of 5.2 cal/gm at 556° K. and heat of fusion of 27.5 cal/gm at 625° K., was subjected to the following rolling treatment: homogenization for 5–18 hours at 650° F.; air cooled to 550° F.; initial reduction to 0.250 inches at 550° F.; air cooled to room temperature; re-heat to 425° F. for 30 minutes; final reduction to 0.100 inch at 425° F.; and air cooled to room temperature.

The thus treated alloy was initially tested in accordance with ASTM E8-69 to determine its tensile strength (TS), yield strength (YS) and percent elongation (%El) characteristics. Thereafter the thus tested alloy was heat aged to 200° F. for 10 days and the said ASTM E8-69 test procedures were repeated to determine, principally the tensile strength stability characteristics of the said alloy. The results of these tests are reported in Table I below.

TABLE I

| Alloy: 9.5% Al; 5.5% Cu; 0.03% Mg; balance Zn | | | | | | | |
|---|---|---|---|---|---|---|---|
| Sample No. | As Rolled TS (lbs/in²) | YS (lbs/in²) | %El | Heat Aged at 200° F for 10 days TS | YS | %El | % Loss of TS |
| 1 | 68,519 | 58,375 | 12 | 63,275 | 43,120 | 10 | |
| 2 | 68,812 | 58,151 | 8 | 62,317 | 43,171 | 5 | |
| Avg. | 68,665 | 58,263 | 10 | 62,796 | 43,146 | 7 | 8.56% |

EXAMPLE 2

A zinc alloy having the following composition: 9.5% Al, 5.50% Cu, and 0.03% Mg, the balance being zinc was prepared essentially as described in Example 1.

The said alloy was subjected to the following rolling treatment: homogenization at 650° F. (5–18 hours); air cooled to 550° F.; initial reduction to 0.250 inch at 550° F.; air cooled to room temperature; homogenization at 500° F. (30 min - 1 hr), and final reduction to 0.100 inch at the following temperatures: 450° F., 425° F., 400° F., 375° F., 350° F., 325° F. and 300° F., followed by air cooling to room temperature in each instance.

The thus treated alloy was initially tested in accordance with ASTM E8-69 to determine its tensile strength (TS), yield strength (YS) and percent elongation (%El) characteristics Thereafter the tested alloy was heat aged for 10 days at 200° F. and the said ASTM test procedures were repeated to determine principally the tensile strength stability characteristics of the said alloy. The results of these tests are reported in Table II, below.

TABLE II

| Sample No. | As Rolled TS | As Rolled YS | As Rolled % El | Temp Final Roll | Heat Aged TS | Heat Aged YS | Heat Aged % El | % Loss in TS |
|---|---|---|---|---|---|---|---|---|
| 3a | 60,728 | 43,109 | 21 | 300° F | 60,051 | 41,414 | 8 | |
| 3b | 60,469 | 42,253 | 17 | 300° F | 58,333 | 39,941 | 10 | |
| 3c | 60,436 | 43,168 | 17 | 300° F | 58,824 | 40,149 | 4 | |
| 3 avg. | 60,544 | 42,844 | 18 | 300° F | 59,069 | 40,502 | 7 | 2.4% |
| 4a | 62,210 | 46,845 | 20 | 325° F | 58,891 | 41,668 | 4 | |
| 4b | 61,752 | 44,707 | 17 | 325° F | 58,046 | 40,412 | 13 | |
| 4c | 61,369 | 44,565 | 19 | 325° C | 58,200 | 41,440 | 2 | |
| 4 avg. | 61,777 | 45,372 | 18 | 325° F | 58,379 | 41,173 | 6 | 5.5% |
| 5a | 61,273 | 45,954 | 11 | 350° F | 58,487 | 41,913 | 6 | |
| 5b | 61,364 | 48,090 | 17 | 350° F | 59,163 | 40,078 | 11 | |
| 5c | 61,842 | 47,348 | 17 | 350° F | 58,476 | 44,616 | 4 | |
| 5 avg. | 61,493 | 47,131 | 15 | 350° F | 58,709 | 42,202 | 7 | 4.5% |
| 6a | 62,787 | 50,783 | 16 | 375° F | 58,421 | 41,925 | 7 | |
| 6b | 63,119 | 50,346 | 15 | 375° F | 58,553 | 43,507 | 6 | |
| 6c | 63,585 | 48,410 | 14 | 375° F | 58,269 | 40,716 | 7 | |
| 6 avg. | 63,164 | 49,846 | 15 | 375° F | 58,414 | 42,049 | 6 | 7.5% |
| 7a | 64,014 | 52,629 | 15 | 400° F | 58,017 | 42,496 | 7 | |
| 7b | 63,909 | 51,279 | 13 | 400° F | 58,638 | 45,608 | 6 | |
| 7c | 63,646 | 51,783 | 12 | 400° F | 57,934 | 44,492 | 4 | |
| 7 avg. | 63,857 | 51,897 | 13 | 400° F | 58,196 | 44,198 | 5 | 8.8% |
| 8a | 65,107 | 53,946 | 15 | 425° F | 59,277 | 44,009 | 6 | |
| 8b | 64,497 | 55,761 | 12 | 425° F | 59,366 | 43,942 | 7 | |
| 8c | 64,660 | 56,998 | 14 | 425° F | 58,264 | 42,654 | 4 | |
| 8 avg. | 64,755 | 55,568 | 13 | 425° F | 58,969 | 43,535 | 5 | 8.9% |
| 9a | 64,665 | 56,394 | 12 | 450° F | | | | |
| 9b | 64,237 | 55,858 | 13 | 450° F | 59,604 | 45,210 | | |
| 9c | 63,866 | 56,187 | 11 | 450° F | 59,000 | 44,250 | | |
| 9 avg. | 64,254 | 56,148 | 12 | 450° F | 59,302 | 44,730 | | 7.7% |

EXAMPLE 3

Shear strength tests were conducted on a zinc alloy having the following composition: 9.5% Al; 5.5% Cu and 0.03% Mg, the balance being Zn, and compared to values achieved under essentially identical conditions, using CDA 353 Brass. The results of these tests are reported below in Table III.

TABLE III

| Material | Test Temp (° F) | Gauge (in) | Key Blank Shear Area ($in^2$) | Press Load (lbs) | Shear Strength ($lbs/in^2$) |
|---|---|---|---|---|---|
| Zinc Alloy | 25 | 0.074 | 0.421 | 19,334 | 45,923 |
| | 150 | 0.074 | 0.421 | 18,547 | 44,054 |
| | 200 | 0.074 | 0.421 | 17,026 | 40,441 |
| CDA 353 Brass | 25° | 0.078 | 0.444 | 21,274 | 47,915 |

EXAMPLE 4

A zinc alloy of the present invention having the following composition: 9.5% Al, 5.5% Cu and 0.03% Mg, the balance being zinc, was compared to a conventional high aluminum containing zinc alloy having the following composition: 25% Al, 1% Cu, 0.03% Mg, the balance being zinc and to brass Ford key blanks to illustrate their torque properties. A ⅛ inch testing standard was utilized. The Ford key was in the unmilled condition and the tests were carried out at room temperature. The results, reported in Table IV below, are an average of 10 torque tests except where otherwise indicated.

TABLE IV

| Material | Gauge (in.) | Starting Torque (in. lbs.) | 30° Torque (in. lbs) | Maximum Rotation (0°) | Maximum Torque (in. lbs.) |
|---|---|---|---|---|---|
| Zn alloy of this invention | 0.075 | 45 | 57 | 44 | 64 |
| High Aluminum Zinc alloy | 0.075 | 41 | 53 | 42 | 55 |
| *CDA 353 Brass | 0.078 | 58 | 77 | 52 | 88 |

*15 tests

EXAMPLE 5

A zinc alloy having the following composition was prepared: 6.5% Al; 3.8% Cu; and 0.03% Mg, the balance being zinc.

The said alloy, having a heat of fusion of 2.1 cal/gm at 556° K. and 23.7 cal/gm at 652° K., was subjected to the following rolling treatment: homogenization for 5 hours at 650° F.; furnace cooled to 550° F.; initial reduction to 0.250 inch at 550° F.; air cooled to room temperature; re-heat to 425° F. for 30 minutes; final reduction to 0.100 inch at 425° F.; and air cooled to room temperature.

The thus treated alloy was initially tested in accordance with ASTM E8-69 to determine its tensile strength (TS), yield strength (YS) and percent elongation (%El) characteristics. Thereafter, the thus treated alloy was heat aged at 200° F. for 10 days and the said ASTM E8-69 test procedures were repeated to determine principally the tensile strength stability characteristics of the said alloy. The results of these tests are reported in Table V, below.

TABLE V

| Alloy: 6.5% Al; 3.8% Cu; 0.03% Mg; balance Zn | | | | | | | |
|---|---|---|---|---|---|---|---|
| | As Rolled | | | Heat Aged at 200° F for Ten Days | | | |
| Sample No. | TS | YS | % El | TS | YS | % El | % Loss of TS |
| 10a | 65,023 | 57,093 | 4 | 53,747 | 41,563 | 8 | |
| 10b | 66,147 | 59,804 | 3 | 56,336 | 37,483 | 7 | |
| 10c | 65,406 | 60,182 | 6 | 55,708 | 41,781 | 10 | |
| 10 avg. | 65,525 | 59,026 | 4 | 55,264 | 40,275 | 8 | 15.7% |

The above Zn-Al-Cu-Mg alloy was then compared to other Zn-Al alloys containing in addition to copper and magnesium, either titanium and/or manganese. Sample 11 is an alloy having the following composition: 7.40% Al; 3.75% Cu; 0.029% Mg; 0.01% Ti; the balance being Zn. Sample 12 is an alloy having the following composition: 7.40% Al; 3.80% Cu; 0.03% Mg; 0.08% Mn; the balance being Zn. Sample 13 is an alloy having the following composition: 7.30% Al; 3.67% Cu; 0.032% Mg; 0.08% Mn; 0.01% Ti; the balance being Zn. Following essentially the same procedures given above, the following results were achieved:

| | As Rolled | | | Heat Aged at 200° F for Ten Days | | | |
|---|---|---|---|---|---|---|---|
| Sample No. | TS | YS | % El | TS | YS | % El | % Loss of TS |
| 11a | 68,039 | 53,821 | 6 | 55,188 | 39,245 | 12 | |
| 11b | 67,621 | 53,567 | 6 | 56,251 | 42,541 | 11 | |
| 11c | 67,295 | 55,300 | 3 | 55,327 | 41,852 | 11 | |
| 11 avg. | 67,651 | 54,229 | 5 | 55,588 | 41,213 | 11 | 17.8% |
| 12a | 66,052 | 52,922 | 8 | 55,613 | 46,512 | 12 | |
| 12b | 67,103 | 55,851 | 5 | 53,744 | 40,459 | 10 | |
| 12c | 66,008 | 54,669 | 9 | 56,007 | 43,425 | 6 | |
| 12 avg. | 66,387 | 54,481 | 7 | 55,121 | 43,466 | 9 | 17% |
| 13a | 66,062 | 59,143 | 2 | 53,182 | 40,707 | 4 | |
| 13b | 66,546 | 59,226 | 5 | 53,072 | 40,841 | 6 | |
| 13c | 65,806 | 60,676 | 2 | 54,984 | 42,935 | 2 | |

-continued

| | As Rolled | | | Heat Aged at 200° F for Ten Days | | | |
|---|---|---|---|---|---|---|---|
| Sample No. | TS | YS | % El | TS | YS | % El | % Loss of TS |
| 13 avg. | 66,138 | 59,682 | 3 | 53,746 | 41,495 | 4 | 18.7% |

It can thus be seen that the addition to the near-eutectic Zn-Al-Cu-Mg alloy composition of this invention of other alloying elements disadvantageously reduces the tensile strength stability of the alloy.

EXAMPLE 6

A zinc alloy having the following composition: 6.5% Al; 3.8% Cu; 0.03% Mg; balance Zn was again prepared and was subjected to the following rolling treatment: homogenization at 650° F. (5 hours); furnace cooled to 550° F.; initial reduction to 0.250 inch at 550° F.; air cooled to room temperature; reheat to 425° F. for 30 minutes; final reduction to 0.100 inch at the following temperatures: 450° F., 425° F., 400° F., 375° F., 350° F., 325° F. and 300° F., followed by air cooling to room temperature in each instance.

The thus treated alloy was initially tested in accordance with ASTM E8-69 to determine its tensile strength (TS), yield strength (YS) and percent elongation (%El) characteristics. Thereafter, the tested alloy was heat aged for 10 days at 200° F. and the said ASTM test procedures were repeated to determine, principally, the tensile strength stability characteristics of the said alloy. The results of these tests are reported in Table VI, below.

TABLE VI

| Sample No. | As Rolled TS | As Rolled YS | As Rolled % El | Temp Final Roll | Heat Aged TS | Heat Aged YS | Heat Aged % El | % Loss in TS |
|---|---|---|---|---|---|---|---|---|
| 14a | 58,308 | 33,299 | 20 | 300° F | 51,765 | 36,975 | 13 | |
| 14b | 58,743 | 39,968 | 19 | 300°F | 51,352 | 38,142 | 14 | |
| 14c | 58,268 | 41,086 | 18 | 300° F | 51,355 | 35,765 | 14 | |
| 14 avg. | 58,440 | 40,117 | 19 | 300° F | 51,491 | 36,960 | 13 | 11.8% |
| 15a | 60,146 | 44,621 | 17 | 325° F | 53,529 | 36,916 | 5 | |
| 15b | 59,757 | 44,818 | 4 | 325° F | 53,609 | 35,800 | 6 | |
| 15c | 59,845 | 51,878 | 12 | 325° F | 53,603 | 38,091 | 6 | |
| 15 avg. | 59,916 | 47,106 | 11 | 325° F | 53,580 | 36,936 | 5 | 10.6% |
| 16a | 62,758 | 48,349 | 14 | 350° F | 55,387 | 39,018 | 4 | |
| 16b | 62,476 | 49,523 | 14 | 350° F | 54,675 | 36,891 | 3 | |
| 16c | 62,676 | 49,531 | 12 | 350° F | 55,582 | 40,646 | 8 | |
| 16 avg. | 62,637 | 49,134 | 13 | 350° F | 55,214 | 38,852 | 5 | 11.8% |
| 17a | 62,717 | 51,049 | 10 | 375° F | 53,853 | 38,984 | 6 | |
| 17b | 61,591 | 49,460 | 10 | 375° F | 53,234 | 37,502 | 6 | |
| 17c | 60,932 | 48,007 | 11 | 375° F | 53,923 | 40,078 | 5 | |
| 17 avg. | 61,747 | 49,505 | 10 | 375° F | 53,670 | 38,855 | 5 | 13.1% |
| 18a | 64,377 | 53,189 | 8 | 400° F | 53,853 | 38,984 | 6 | |
| 18b | | | | 400° F | 53,234 | 37,502 | 6 | |
| 18c | 64,123 | 53,436 | 7 | 400° F | 53,923 | 40,078 | 5 | |
| 18 avg. | 64,250 | 53,312 | 8 | 400° F | 53,670 | 38,855 | 5 | 13.1% |
| 19a | 61,574 | 55,719 | 6 | 425° F | 53,390 | 39,202 | 11 | |
| 19b | 63,155 | 55,614 | 6 | 425° F | 54,998 | 39,679 | 12 | |
| 19c | 62,486 | 54,693 | 6 | 425° F | 53,708 | 39,545 | 7 | |
| 19 avg. | 62,385 | 55,342 | 6 | 425° F | 54,032 | 39,476 | 10 | 13.3% |
| 20a | 62,584 | 56,018 | 9 | 450° F | 54,393 | 41,627 | 6 | |
| 20b | 62,726 | 55,236 | 6 | 450° F | 55,004 | 41,952 | 12 | |
| 20c | 62,225 | 55,458 | 8 | 450° F | 55,051 | 42,776 | 9 | |
| 20 avg. | 62,508 | 55,571 | 7 | 450° F | 54,816 | 42,118 | 9 | 12.3% |

EXAMPLE 7

Table VII below summarizes a comparative study of some significant properties of standard die-cast grade alloys (AG40A and AG41A), low-aluminum zinc alloys A and B of the present invention and a high aluminum containing zinc alloy C.

TABLE VII

| Alloy | Chemical Composition (wt %) (Al) | (Cu) | (Mg) | (Cd) | (Fe) | (Pb) | (Sn) | Castability - Melting Range - ° F (Total)/(Range) | Ultimate Tensile Strength (TS) As-Cast | As Rolled | As-Aged (200° F) | % Loss in TS |
|---|---|---|---|---|---|---|---|---|---|---|---|---|
| AG40A | 3.5–4.3 | 0.25 max. | 0.03–0.08 | 0.005 max | 0.100 max | 0.007 max | 0.005 max | (11)/(717–728° F)[2] | 41,000[1] | | 28,300[1],[3] | 31% |
| AG41A | 3.5–4.3 | 0.75–1.25 | 0.03–0.08 | 0.005 max | 0.100 max | 0.007 max | 0.005 max | (10)/(717–727° F)[2] | 47,600[1] | | 35,100[1],[3] | 26% |
| A | 6.4–6.6 | 3.7–3.9 | 0.02–0.04 | 0.005 max | 0.100 max | 0.007 max | 0.005 max | (45)/684–729° F) | | 61,000 | 54,000[5] | 11% |
| B | 9.4–9.6 | 5.4–5.6 | 0.02–0.04 | 0.005 max | 0.100 max | 0.007 max | 0.005 max | (68)/(684–752° F) | 37,900 | 63,000 | 60,200[5] | 4% |
| C | 24–26 | 0.9–1.1 | 0.02–0.04 | 0.005 max | 0.100 max | 0.007 max | 0.005 max | (223)/(705–928° F)[4] | | 62,500[4] | 54,500[4] | 13% |

[1]ASTM B-86 and "Zinc - The Science and Technology of the Metal, Its Alloys and Compounds", C. H. Matthewson, Reinhold Publishing Corp., 1960.
[2]The Metals Handbook, , Vol. 1, 8th Ed. ASM, 1967.
[3]Aged at 203° F.
[4]"Experimental High Strength Zinc Alloy", D. L. Dollar, report, Aug. 14, 1973.
[5]Aged at 200° F for 10 days.

From the data reported in Table VII, it can be seen that alloys A and B of the present invention exhibit not only the advantageous casting properties of standard die-cast grade alloys, i.e., AG40A and AG41A, and the high tensile strength properties of high aluminum zinc based alloys, for example alloy C, but they also exhibit, as noted earlier, a higher level of strength stability.

EXAMPLE 8

A zinc alloy of the present invention having the following composition: 6.5% Al, 3.8% Cu and 0.03% Mg, the balance being zinc was compared to a conventional high aluminum containing zinc alloy having the following composition: 25% Al, 1% Cu, 0.03% Mg, the balance being zinc and to CDA 353 brass to illustrate their relative shear strength properties. The shear strength value determined for the zinc alloy of the present invention was 38,424 lbs/in$^2$ while that for the high aluminum zinc alloy was 38,881 lbs/in$^2$ and that for brass was 49,422 lbs/in$^2$.

A processing operation, alternative to that utilized in certain of the above example, which is particularly advantageous for a zinc alloy of the present invention having the following composition: 9.5% Al, 5.5% Cu and 0.03% Mg, the balance being zinc, comprises continuously casting said zinc alloy as an air-cooling strip, generally having a thickness of 0.500 inch and a width ranging from 17 to 27 inches; hot rolling the said air-cooling strip at approximately 550° F. to an initial reduction of 0.250 in. thick; coiling the said initially reduced strip and air cooling it to ambient temperature at a rate of about 3°–5° F./min; heating the said coils to a temperature above 620° F. for about 3 hours; furnace cooling the said coils to about 600° F. for a period of approximately 2 hours at a minimum; hot rolling said coils to a final reduction wherein the entry rolling temperature ranges from about 580° F. to 600° F. and the exit rolling temperature ranges from about 220° F. to 250° F.; cooling to room temperature in forced air; reheating for slitting to a temperature of about 220° F. to 240° F.; slitting said finally reduced coils to, for instance, 3 inch widths; and air cooling the same.

As an alternative, slitting and air cooling can take place immediately after the coil exits from the final rolling operation.

What is claimed is:

1. An improved continuously castable zinc base alloy consisting essentially of 9–10 percent by weight aluminum, 5–6 percent by weight copper and 0.02–0.04 percent by weight magnesium, the balance being zinc.

2. An improved continuously castable zinc base alloy consisting essentially of 9.4–9.6 percent by weight aluminum, 5.4–5.6 percent by weight copper and 0.028–0.032 percent by weight magnesium, the balance being zinc.

3. An improved continuously castable zinc base alloy consisting essentially of 9.5 percent by weight aluminum, 5.5 percent by weight copper and 0.03 percent by weight magnesium, the balance being zinc.

4. An improved continuously castable zinc base alloy consisting essentially of 6.4–6.6 percent by weight aluminum, 3.7–3.9 percent by weight copper and 0.02–0.04 percent by weight magnesium, the balance being zinc.

5. An improved continuously castable zinc base alloy consisting essentially of 6.5 percent by weight aluminum, 3.8 percent by weight copper and 0.03 percent by weight magnesium, the balance being zinc.

* * * * *